United States Patent [19]

Lovat

[11] 4,010,616

[45] Mar. 8, 1977

[54] RIB EXPANDER

[76] Inventor: Richard Lovat, 42 Grovetree Ave., Rexdale, Canada

[22] Filed: Sept. 23, 1975

[21] Appl. No.: 615,899

[52] U.S. Cl. ..... 61/45 R; 61/42; 61/84

[51] Int. Cl.[2] ..... E21D 11/12

[58] Field of Search ..... 61/84, 85, 41 C, 45 C, 61/42; 299/31, 33

[56] References Cited

UNITED STATES PATENTS

| | | | |
|---|---|---|---|
| 1,292,203 | 1/1919 | Wolfe | 61/84 |
| 2,919,121 | 12/1959 | Ruth | 61/84 |
| 3,373,571 | 3/1968 | Records | 61/84 |
| 3,411,826 | 11/1968 | Wallers et al. | 61/85 |
| 3,550,389 | 12/1970 | Khodosh et al. | 61/84 |
| 3,716,997 | 2/1973 | Rees et al. | 61/85 |
| 3,800,549 | 4/1974 | Lebbe | 61/85 |
| 3,896,629 | 7/1975 | Stevens | 61/84 |
| R26,132 | 1/1967 | Cerutti | 61/84 |

*Primary Examiner*—Paul R. Gilliam
*Assistant Examiner*—Alex Grosz

[57] ABSTRACT

A rib expander, for use with tunnelling apparatus, in which a plurality of arcuate segmental members form a ring, at least two of the members being separable longitudinally to expand the ring. The ring is mounted to provide pivotal movement about a vertical circumferential axis of the ring as well as transverse movement in the plane of the ring and movement along the normal axis of the ring.

9 Claims, 5 Drawing Figures

RIB EXPANDER

This invention relates to apparatus for use with an earth tunnelling machine and more particularly to a device for placing arcuate ribs to form a tunnel wall.

Earth tunnelling machines presently in use employ a toothed conical head rotatably mounted at one end of a cylindrical housing. As the cutting head rotates and the housing advances, the teeth on the head loosen the soil which passes through apertures in the head into the housing where it is collected and conveyed rearwardly. An example of such a tunnelling machine is shown in my copending U.S. Pat. application Ser. No. 494,609 filed Aug. 5, 1973 now U.S. Pat. No. 3,961,825.

As the head of the tunnelling machine rotates, the housing is advanced by hydraulic jacks which bear against a lining placed in position against the wall of the tunnel beyind the housing. The lining is formed by circular ribs located at spaced intervals along the tunnel wall with horizontal slats of wood bridging placed as lagging between the ribs.

It is advantageous to form the ribs within the housing of the tunnelling machine but when the ribs pass from the housing into the tunnel, by reason of the advancement of the machine within the tunnel, there remains a gap between each rib and the surrounding tunnel wall. In practice this gap is either ignored or suitably filled by grouting or other means. Another problem of lining a tunnel is the orientation of ribs where the tunnel is curved.

It is an object of this invention to provide an improved device for orienting the circumferential ribs of a tunnel wall lining. The present invention achieves this by mounting the rib expander to provide pivotal movement about a vertical circumferential axis as well as transverse movement in the plane of the ring and movement along the normal axis of the ring.

An example embodiment of the invention is shown in the accompanying drawings in which.

Figure 1:
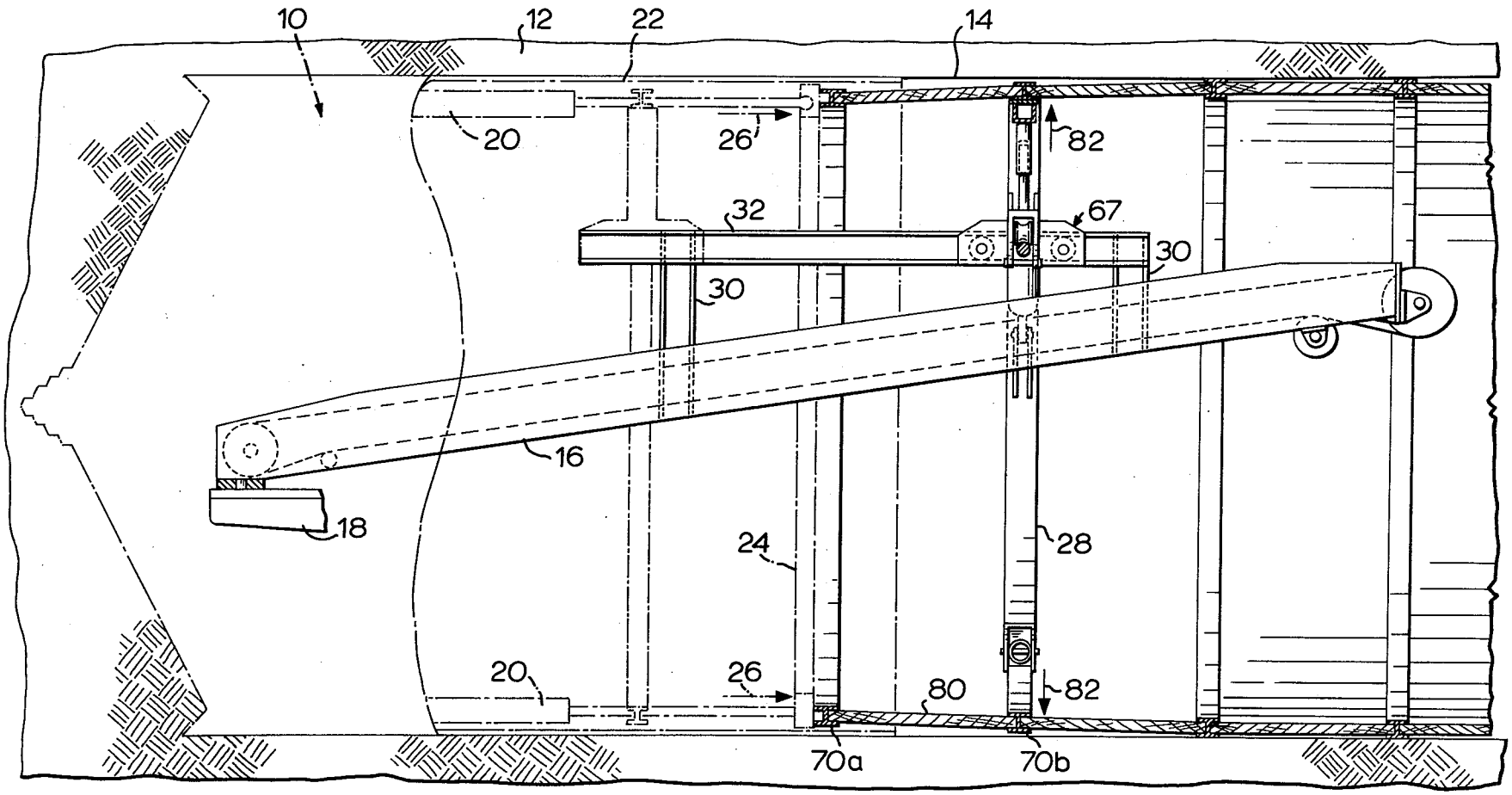
FIG. 1 is a vertical view in cross-section of a tunnelling machine located in the earth and carrying a rib expander used to move a lining rib against the tunnel wall behind the tunnelling machine.

FIG. 1 of the drawings shows a tunnelling machine 10 of the type disclosed in my above-mentioned application Ser. No. 494,609 now U.S. Pat. No. 3,961,825, which moves through earth 12 to form a tunnel 14. Tunnelling machine 10 includes a conveyor 16 which is mounted on a fixed bracket 18 and a plurality of hydraulic jacks 20 which are mounted adjacent cylindrical housing 22 of the tunnelling machine. Jacks 20 carry a pusher ring 24 extendable rearwardly by the jacks in the direction of arrows 26.

A rib expander 28 is mounted on conveyor 16 by brackets 30 which carry a pair of opposed channels opening inwardly to form horizontal rails 32. Rib expander 28 comprises three segmental arcuate members 34 disposed to form a ring with an upper member **34*a* and two opposed lower members 34*b*. Each member 34 is formed of a channel 36 enclosed by a shoe 38. Lower segmental members 34*b* terminate at their lower ends each in a horizontal fork 40, the forks being spaced apart. One end of a connector arm 42 is pivotally attached to one of forks 40 by a pin 41 while the other end of the connector arm carries a transverse pin 44 which is receivable in a transverse vertical slot 46 in the other fork. A handle 48 on connector 42 enables it to be pivoted about pin 41 as indicated by arrow 49 in FIG. 2. The bottom end of vertical slot 46 terminates in a horizontal portion 46*a***.

Each end portion of upper segmental member **34*a* is connected to the adjacent upper end portion of a lower segmental member 34*b* by a double-acting hydraulic jack 50 which is pivotally connected to flanges 52 fixed on channel 36 of members 34*a* and 34*b* respectively. A guide tongue 54 is pivotally mounted one at each end of member 34*a* and has its free end slidably inserted into channel 36 of adjacent member 34*b***.

Upper member **34*a* carries a centrally located, downwardly extending socket 56 which receives an upwardly extending pin 58 integral with a downwardly opening yoke 60. A grooved roller 62 is rotatably mounted in yoke 60 and rests on a round crossbar 62. A pin 64 bridges the free ends of yoke 60 below crossbar 62, as best seen in FIG. 1. Crossbar 62 connects a pair of spaced carriage wheel assemblies 66 forming a carriage 67 which rolls on rails 32 mounted on conveyor 16**.

Figure 2:
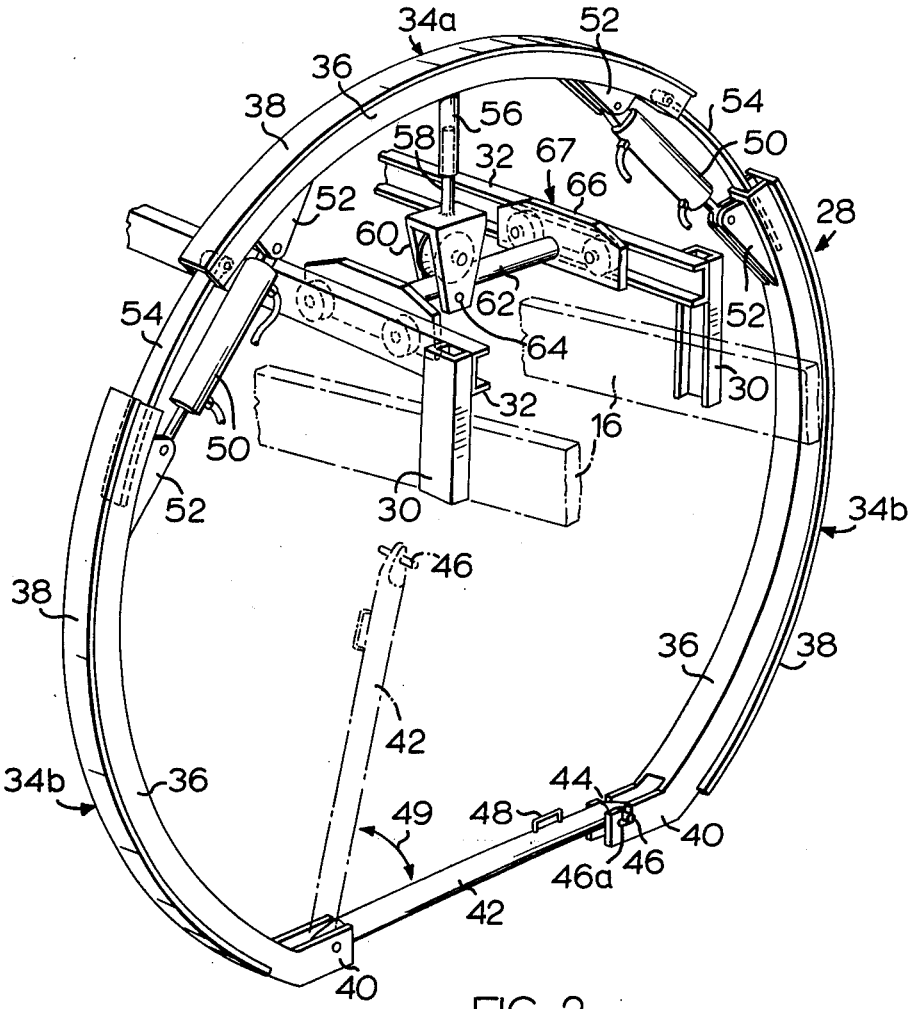
FIG. 2 is a perspective view of the rib expander of FIG. 1 in a retracted position.

In the operation of the example embodiment a circular rib 70 is first assembled as shown in FIG. 2 of the drawings but without expander 28. Rib 70 consists of three arcuate I-beam segments 72 disposed to form a ring with an upper segment **72*a* and two lower opposed segments 72*b*. Each end of each segment 72 carries an end plate 74 projecting radially inward. Lower segments 72*b* have their abutting end plates 74 fastened by a fixed bolt 76 while the abutting end plates between lower segments 72*b* and upper segment 72*a* are connected by expandable bolts 78**.

Figure 3:
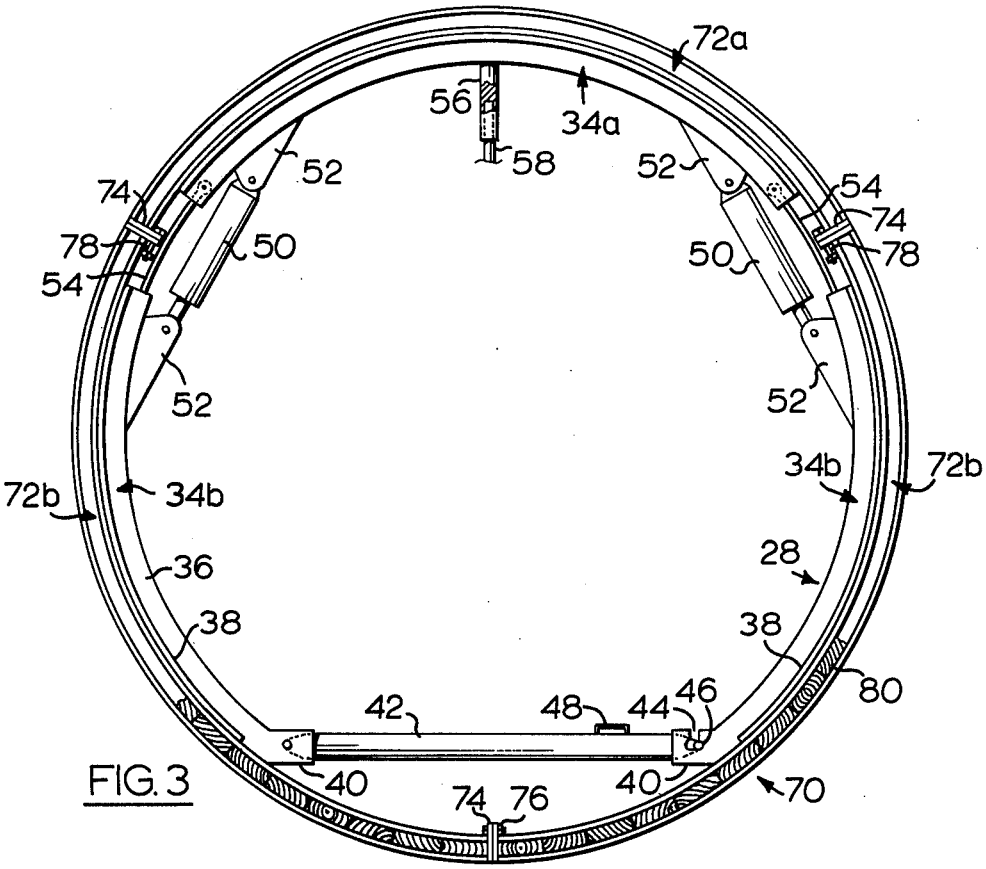
FIG. 3 is a front view in elevation showing the rib expander of FIG. 2 and carrying a lining rib.
Figure 4:
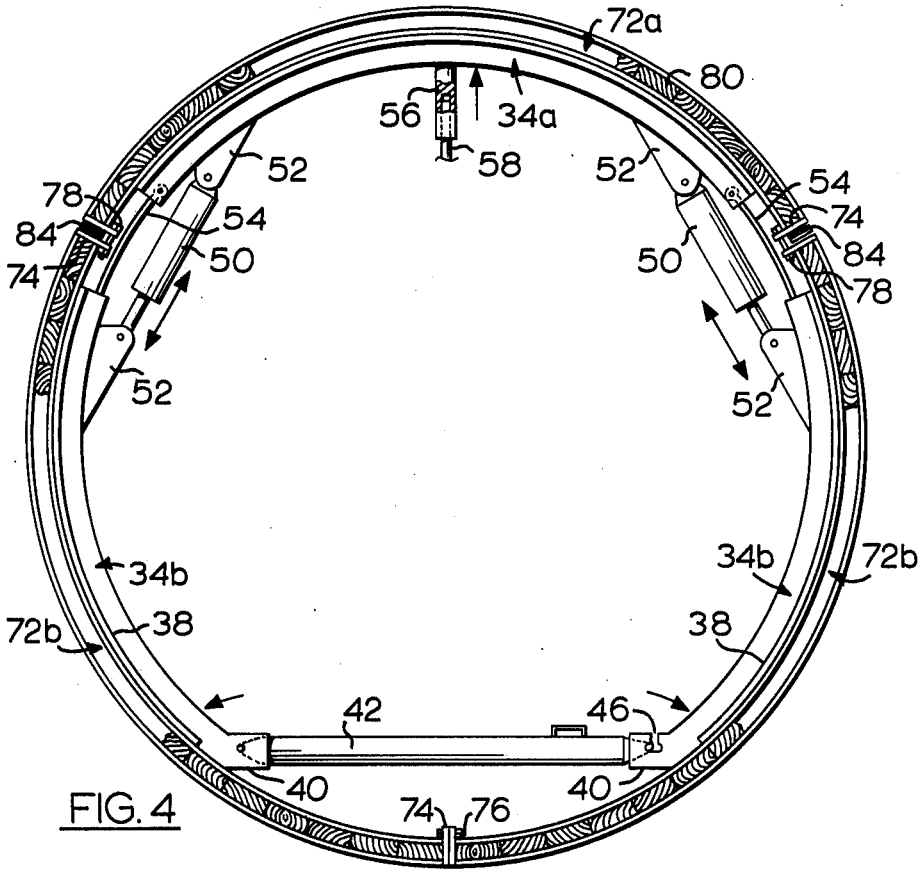
FIG. 4 is a view similar to FIG. 3 showing the rib expander in expanded position.

Rib 70 is assembled within housing 22 of tunnelling machine 10 as indicated by numeral **70*a*. Lagging 80 is then placed between rib 70*a* and a previously assembled rib 70*b* to form a cylindrical timber wall lining. When lagging 80 is in place, pusher ring 24 is placed against rib 70*a*. Tunnelling machine 10 is then able to be advanced by actuating hydraulic jacks 20 as the head of the tunnelling machine rotates to excavate earth in front of the machine. As tunnelling machine 10 advances, rib 70 becomes located outside housing 22 in the position of rib 70*b*. Rib expander 28, with hydraulic jacks 50 retracted, is moved by carriage 67 into position inside rib 70*b* and concentric with the rib, as seen in FIGS. 1 and 3. This is accomplished by lifting connector arm 42 about pin 41 to disengage pin 44 from slot 46, allowing the lower ends of segmental members 34*b* to be moved towards one another. When expander 28 has been positioned within rib 70*b*, connector arm 42 is lowered to have pin 44 reengage slot 46**.

To expand rib **70*b*, hydraulic jacks 50 of expander 28 are actuated and extended, causing segmental members 38*b* to separate longitudinally from segmental member 38*a*. This causes lower segments 72*b* to separate longitudinally from upper segment 72*a* of the rib and presses rib 70*b* outwardly in the direction of arrow 82 against the wall of tunnel 14. The spaces opened between segments 72*b* and segment 72*a* are filled by shims 84. Hydraulic jacks 50 are then retracted to move segment members 38*b* of expander 28 longitudinally towards segment member 38*a*, allowing the expander to be withdrawn from within rib 70*b* by moving carriage 67 along rails 32 back into housing 22 of tunnelling machine 10 where it is held in readiness for placement within the next rib 70 to be expanded against the wall of tunnel 14.**

It will be appreciated that expander 28 could be moved along rails 32 either manually or by power driven means such as an electric motor mounted on one of carriage wheel assemblies 66.

I claim:

1. A rib expander, for use with tunnelling apparatus where the tunnel being driven is curved, comprising:

a plurality of elongated arcuate segmental members forming a sectioned ring;

means to separate at least two of the members longitudinally one from another along the circumferential axis of the ring whereby the ring is radially expandable;

means for horizontally translating the ring normal to the plane thereof; and means carried by the horizontal translating means to support the ring in a vertical plane thereon, said support means being constructed and arranged whereby the ring is (a) movable on the horizontal translating means transversely in the plane of the ring and (b) movable pivotally about a vertical circumferential axis thereof.

2. A rib expander as claimed in claim 1 in which the means to separate the members comprises an hydraulic jack bridging said members and pivotally connected thereto.

3. A rib expander as claimed in claim 1 in which the ring comprises an upper member horizontally oriented with respect to the longitudinal axis thereof and a pair of opposed lower members vertically oriented with respect to the longitudinal axis thereof, each end portion of the upper member being connected to the adjacent lower member by a separate jack.

4. A rib expander as claimed in claim 3 in which the lower end portions of the lower members are spaced apart, and releasable means interconnecting said lower end portions.

5. A rib expander as claimed in claim 4 in which the lower ends of the lower members form forks, the releasable means comprising an arm connected pivotally to one of said forks for lateral movement and releasably engagable with the other of said forks.

6. A rib expander as claimed in claim 3 in which the members each comprises a channel and a shoe enclosing the channel, and a pair of guide members one interconnecting the end portion of the upper member with the upper end portion of the adjacent lower member, each guide member comprising a tongue connected to one of said end portions and slidable in the adjacent end portion.

7. A rib expander as claimed in claim 1 in which the translation means comprises a pair of rails and a carriage movable along the rails, and the support means comprises means movable horizontally on the carriage transverse to the rails, the ring being freely supportable on the transversely movable means.

8. A rib expander as claim in claim 7 in which the carriage includes a crossbar circular in cross-section, the transversely movable means comprising a circumferentially grooved roller movable freely along the crossbar.

9. A rib expander as claim in claim 8 in which the roller is mounted rotatably in a downwardly opening yoke having an upwardly projecting pin fixed to the base thereof, a downwardly projecting socket being fixed to one of the segmental members, the pin being receivable in the socket whereby the ring is pivotable thereon.

* * * * *